US005238637A

United States Patent [19]

Chaubet et al.

[11] Patent Number: 5,238,637

[45] Date of Patent: Aug. 24, 1993

[54] PROCESS FOR OBTAINING POLYAMIDE YARNS WITH BETTER OUTPUT EFFICIENCY

[75] Inventors: Olivier Chaubet, Lyons; Walter Roggenstein, Sainte Foy les Lyon; Noël Witmeyer, Saint-Just Chaleyssin, all of France

[73] Assignee: Rhone-Poulenc Fibres, Lyons, France

[21] Appl. No.: 889,078

[22] Filed: May 21, 1992

[30] Foreign Application Priority Data

Jun. 7, 1991 [FR] France ..... 91 07190

[51] Int. Cl.[5] ..... D01F 1/10; D01F 6/26

[52] U.S. Cl. ..... 264/211; 264/211.14

[58] Field of Search ..... 264/210.6, 211, 211.12, 264/211.14

[56] References Cited

U.S. PATENT DOCUMENTS

| | | | |
|---|---|---|---|
| 2,385,890 | 10/1945 | Spanagel | 264/210.1 |
| 2,818,173 | 1/1958 | Dithmar | 209/513 |
| 3,994,121 | 11/1976 | Adams | 57/243 |

FOREIGN PATENT DOCUMENTS

| | | | |
|---|---|---|---|
| 80274 | 5/1986 | European Pat. Off. . | |
| 1225382 | 12/1964 | Fed. Rep. of Germany | 264/211 |
| 951371 | 10/1949 | France . | |
| 1169578 | 12/1958 | France . | |
| 1428439 | 1/1966 | France . | |
| 2274710 | 1/1976 | France . | |
| 53-111121 | 9/1978 | Japan | 264/211 |

OTHER PUBLICATIONS

World Patent Index, Section CH, week 7844, Derwent Publications (GB), Class A, AN 78-79190a (& JP-A-53 111 121) (1978).

*Primary Examiner*—Leo B. Tentoni

*Attorney, Agent, or Firm*—Stevens, Davis, Miller & Mosher

[57] ABSTRACT

Process for improving the output efficiency during the spinning of a polyamide-based preoriented yarn at a speed of at least 4000 m/min by introduction, before the spinning, of a quantity of 0.05 to 1% by weight of pyrogenic silica of particle size of between 5 and 15 nm into the molten polymer in the form of dispersion in a master mix of the same polyamide as than intended to be processed, the filaments after spinning being then cooled by means of a gas stream at room temperature and then sized and wound at a speed of between 4200 and 5800 m/min.

The preoriented yarns thus prepared exhibit a delay in the orientation and are obtained with a gain in output efficiency of at least 10%, generally at least 15%.

3 Claims, 1 Drawing Sheet

PROCESS FOR OBTAINING POLYAMIDE YARNS WITH BETTER OUTPUT EFFICIENCY

BACKGROUND OF THE INVENTION

1. Field of the Invention

The present invention relates to a process which makes it possible to obtain undrawn filaments based on polaymide (PA) with better output efficiency.

It also relates to polyamide-based undrawn modified yarns suitable for texturing by and drawing false-twist texturing.

2. Description of the Related Art

Undrawn polyamide-based yarns which are generally employed for the operation of drawing-texturing using false twist must have orientation and low crystallinity properties so as to orient the macromolecules better and then to crystallize and thus set the orientation during the drawing-texturing process without degrading or breaking the filaments during the thermal setting of the yarn.

In particular, it is known according to French patent application published under no. 2,274,710 to prepare PA yarns which can be employed directly in processes for drawing-texturing using false twist, by melt-spinning polyhexamethylmethylene adipamide, cooling, treatment in an atmosphere of water vapor and under pressure to obtain the desired yarn properties, and preferably a slight overdrawing of the yarns before winding. The latter is carried out at speeds which are generally between 270 and 4000 m/min.

To increase the spinning speed without substantially modifying the crystallinity and orientation properties of the undrawn POY yarns, it has also been proposed in European patent application published under no. 080,274 (A) to introduce into the molten PA polyethylene or polypropylene subsequently forming microfibrils in the filaments obtained.

However, the addition of polymer in the form of fine particles present disadvantages when carried out industrially: in particular, it requires a highly sophisticated technology for obtaining mixtures which have sufficient fineness and stability with time to permit reliable spinning without strand breakages. As a result, such a technique cannot be employed industrially.

It is also known to improve the output efficiency of unoriented PA yarns suitable for texturing using false twist, by introducing into the polymeric chains from 0.01 to 1 mol % of a branching agent such as bishexamethylenetriamine or trimesic acid or 4-aminomethyl-1,8-diaminooctane. However, such compounds modify the rheology of the polymer by increasing its viscoelasticity, with the result that spinning such copolymers becomes very tricky and present considerable risks of strand breakages.

Moreover, it is also known, according to French patent application published under no. 1,428,439, to prepare PA resin compositions containing silica in the form of particles of $<10$ μm of specific conductance $<5\times10^{-4}$ mho/cm.

However, the use of such compositions relates to plastics applications.

It is also known, according to French patent no. 1,169,578 to prepare PA compositions for compression and injection moulding which have wider softening and melting ranges, making it possible to maintain a viscous flow and to avoid gels by incorporating into the PA inorganic fillers such as $SiO_2$ with a particle size of 1 to 40 μm.

SUMMARY OF THE INVENTION

The subject of the present invention is the preparation of preoriented, undrawn, PA-based yarns with an improved output efficiency.

More particularly, it relates to a process for improving the output efficiency during the spinning of a polyamide-based preoriented yarn at a speed of at least 4000 m/min, by introducing, into the molten polymer before spinning, a quantity of 0.05 to 1%, preferably of 0.05 to 0.5%, by weight of pyrogenic silica, of particle size of between 5 and 15 nm, in the form of dispersion in a master mix of the same PA as that intended to be processed. The mean interparticular distance of the $SiO_2$ aggregates in the final polymer is between 0.2 and 0.7 μm, the maximum value between 2 aggregates being $\leqq 3$ μm.

After spinning, the filaments are cooled by means of a gas stream to room temperature and are then sized and wound at a speed which is preferably between 4200 and 5000 m/min, the filaments being preferably mingled before being wound.

The output efficiency gain obtained is greater than 10%, more generally greater than 15% or even more.

The present invention also relates to PA-based undrawn preoriented filaments containing 0.05 to 1%, preferably 0.05 to 0.5%, by weight of pyrogenic silica of particle size of between 5 and 15 nm (50 to 150 Å) distributed uniformly in the PA, introducing a delay in crystallization and orientation.

BRIEF DESCRIPTION OF THE DRAWINGS

The sole FIGURE is a graphical representation of percent elongation (E%) plotted against spinning speed (expressed in V-m/min) of two embodiments of the present invention together with a control.

DESCRIPTION OF THE PREFERRED EMBODIMENTS

Figure 1:
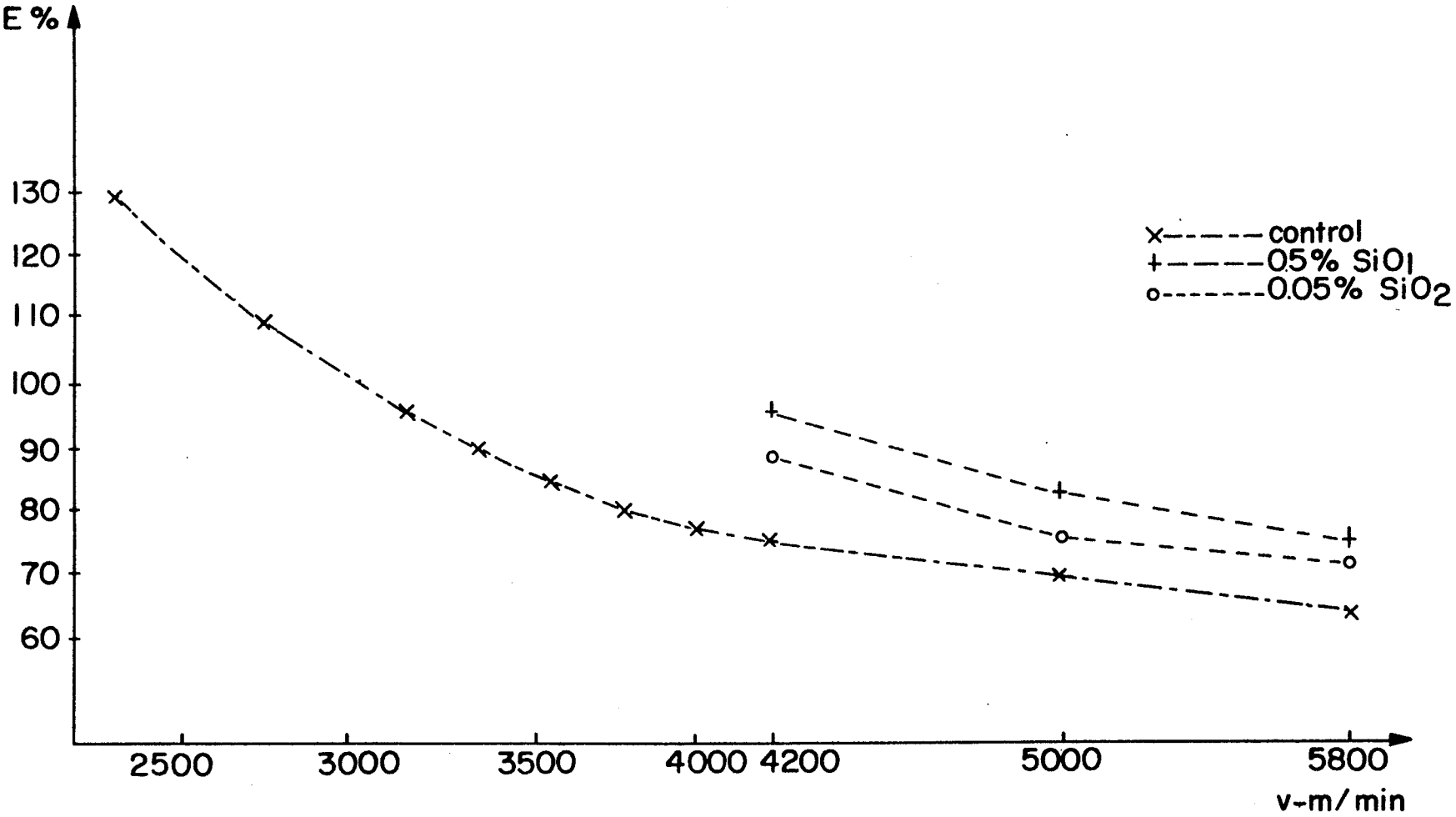

In the description, polyamide is intended to means polyhexamethylene adipamide or copolyamides containing at least 85% of hexamethylene adipamide units and up to 15% of other units obtained by replacing, for example, the starting adipic acid with another diacid such as terephthalic or sebacic acid and/or by replacing the two monomers with, for example, caprolactam.

The starting polyamides may also contain known additives such as delustring agents, agents for stabilization against light, heat and oxidation, additives intended to reduce the accumulation of static charges or to modify dyeability, and the like.

The polyamide employed according to the present invention exhibits a relative viscosity, measured on a solution containing 8.4% by weight per volume in 90% formic acid, of between 38 and 52, preferably approximately 40.

The expression pyrogenic silica is intended to means silicon dioxide obtained by combustion of an organosilicon compound and available in the trade under different trademarks such as the AEROSIL 300 (hereinafter A300) type from Degussa, or a silicon dioxide surface-treated in a known manner to prevent reagglomeration. Silicas are ultrafine fillers which are in the form of aggregates consisting of elementary particles with a specific surface of between 100 and 450 $m^2/g$, whose size is between 5 and 15 nm (50 to 150 Å), more generally of the order of a hundred Å and grouped in linear chains.

According to the invention the pyrogenic silica is mixed with PA which is identical with the PA to be processed in a melt-blending apparatus such as a twin-screw extruder or any appropriate device, in proportions such that a master mix containing 1–10% of silica, preferably 2–5%, is obtained in the form of granules at 260°–280° C., preferably approximately 260°–270° C.

The master-mix granules thus obtained contain silica which is very uniformly distributed. The distribution in the final polymer is evaluated using the means interparticular distance of the aggregates.

In fact, according to the invention, the means interparticular distance of the aggregates in the final polymer is between 0.2 and 0.7 μm, the maximum value between two silica aggregates being ≦3 μm. This evaluation is performed starting with photographs produced by electron microscopy, the photographs being subsequently processed by image analysis in order to find out the number of particles and to calculate the interparticular distance of each aggregate.

The interparticular distance obviously depends on the proportion of silica introduced: the higher the latter, the lower will be the interparticular distance. Furthermore, the dispersion of silica in the polyamide depends partly on the type of silica employed, some coated silicas dispersing better than uncoated silicas.

If the silica content is >1%, this will affect the rheological behaviour of the polymer and, in particular, the spinning runs the risk of being perturbed by strand breakages.

If the silica content is lower than 0.05%, the means interparticular distance becomes too high, the silica content introduced is insufficient to modify the structure of the polyamide, with the result that the effect sought after is not obtained.

The master mixs are introduced, in various proportions depending on the desired silica content, into the polyamide, which may be either in the molten state or in the form of granules, before the spinning, for example by means of a twin-screw blending extruder heated between 260°–270° C. or any other appropriate means.

According to the invention, the silica content desired in the yarn is between 0.05 and 1%, preferably 0.05 and 0.5% by weight.

The spinning is carried out at the usual temperatures in the case of the polyamide between 280° and 295° C., preferably close to 285° C. and the filaments are cooled under the die with a cooling gas stream and are then sized and wound at speeds of between 4200 and 5800 m/min. The cooling conditions may vary as a function of the cooling device employed, the precise spinning speed and the count and the number of filaments, these settings being within the competence of a person skilled in the art.

The filaments are preferably interwoven and/or intermixed before winding for better subsequent unwindability.

Surprisingly and unexpectedly, the process according to the invention makes is possible to obtain preoriented, undrawn filaments with an improved output efficiency higher than 10%, generally higher than 15% or even more, due to a delay in orientation of the filaments: that is to say that for the same degree of orientation of the filaments the winding speed is higher than 10% or even 15% and more.

Scientific studies show that when undrawn PA yarns are obtained directly from very low speeds (500 to 1000 m/min) up to at least more than 6000 m/min, a strong orientation of the crystalline and amorphous regions is observed first of all, then a lower orientation, the orientation being developed essentially by the spinning stress which is, above all, a function of the haul-off speed and of the filament count. The orientation state of the material, in particular the orientation of the amorphous phase, the organization of the crystalline and amorphous phases and the interface between the crystalline and amorphous phases, for a given polyamide, is clearly revealed by the elongation at break of the yarns originating from this material. In fact, this decreases considerably from spinning speeds ranging from 1000 m to 4000 m/min, and then markedly more slowly from 4000 to 6000 m/min and beyond. As a result, it is difficult to obtain undrawn preoriented polyamide yarns, suitable for the drawing-texturing processes employed at present at speeds higher than 4000 m/min.

According to the present invention, it has surprisingly been found that the introduction of 0.05 to 1%, preferably 0.05% to 0.5%, of pyrogenic silica produces a delay in the decrease in elongation at break or close to the break of the filaments as a function of spinning speed, a delay which corresponds to a delay in the orientation of the filaments along the spinning path. This delayed orientation makes it possible to obtain undrawn, preoriented yarns which have characteristics identical with those of the yarns obtained at speeds which are at least 10%, more generally at least 15%, lower, calculated in relation to the values of their elongation at break, or their elongation corresponding to the same stress, close to the break.

According to the invention the values of elongation at break or at a given stress are measured with a normal tensometer known in the trade under the trademark INSTRON 1122 linked to a calculator; each value represents the means of 20 measurements.

$$\text{Elongation at a reference stress: } \frac{ls - lo}{lo} \times 100$$

ls=length corresponding to the reference stress or break, lo=initial length.

FIG. 1 shows the shift in the values of elongation at break as a function of the spinning speed using yarns filled with 0.05 and 0.5% by weight of silica respectively, compared with an unfilled control polymer and in the case of speeds higher than 4000 m/min. The value of the elongations of control undrawn polyamide yarns spun at speeds lower than 4000 m/min is also shown for reference.

The delay in the orientation of the modified yarns according to the invention is confirmed by the values of the sonic modulus and of birefringence, which are measured in the following manner.

Sonic modulus=a measurement is made of the change in electrical phase caused by the variations in the lengthwise mechanical wavelength of a yarn which runs between a probe emitting at a frequency of 6750 cycles/s and a receiver probe. The phase changes, using a simple relationship, directly represent the changes in the velocity of sound which are the image of the changes in modulus, using well-known changes. The sonic or dynamic modulus is directly proportional to the square of the velocity of sound in the sample by the density of the substance.

Birefringence = measured only on a circular strand.

The birefringence of a filament gives evidence of the macromolecular orientation of its substance. It is equal to the difference in the refractive indices in directions parallel and perpendicular to the axis of the filament:

$$\Delta\eta = \eta \parallel - \eta\perp$$

The refractive indices are obtained by an optical compensation method (polarised light and Berek compensator) on an individual filament kept stretched under weak tension in dispersion in vaseline oil.

The present invention makes it possible therefore to produce, at spinning speeds higher than 4000 m/min, undrawn, preoriented polyamide yarns exhibiting a delayed orientation corresponding to those of yarns obtained at speeds which are at least 10%, more generally 15% or even more, lower. Such yarns, which have a delayed orientation, exhibit the mechanical characteristics of yarns obtained at much lower speeds, and this permits their texturing using false twist under good conditions using spindle or friction processes for simultaneous drawing texturing. They can also be employed for all the textile conversions such as weaving, knitting or the manufacture of nonwoven sheets.

Furthermore, the introduction of silica does not impair the mechanical properties of the yarns which are needed for their subsequent use; moreover, pyrogenic silica is relatively inexpensive and does not require any major modification of industrial spinning plants.

The examples which follow are given by way of guidance but without any limitation, to illustrate the invention.

EXAMPLES 1 TO 3

A master mix containing 5% of silica is produced by means of an entirely meshed, co-rotating twin-screw extruder known in the trade under the trademark Leistreitz LSM 30/34, working at a mean rate of rotation of 300 rev/min and at a varying temperature of 260°–270° C.

The pyrogenic silica employed is an ultrafine commercial filler of A 300 type from Degussa. It is in the form of aggregates consisting of elementary particles with a specific surface of 300 $m^2/g$, of apparent density of 0.05 to 0.06, the particle size being between 5 and 15 nm (50 to 150 Å). The master mix containing 5% of silica is then introduced in various proportions, depending on the desired final silica content, into the molten polyamide before the spinning, by means of a twin-screw blending extruder heated to a temperature rising from 260° to 270° C. and with a rate of rotation of 300 revolutions/min.

The temperature profile enables the polyamide stock to melt before the addition of the filler, which therefore takes place in a melt medium. A vacuum zone is established over a part of the extruder in order to ensure drying of the polyamide.

The final silica content and the mean interparticular distance between aggregates in the final polymer are as follows:

| | Silica content by weight | Mean interparticular distance between aggregates |
|---|---|---|
| Ex. 1 | 0.05% | 1 μm |
| Ex. 2 | 0.25% | 0.7 μm |
| Ex. 3 | 0.50% | 0.7 μm |

The silica-filled polyamide is spun through a die plate maintained at 283° C., comprising 2 times 7 orifices of round section 0.34 mm in diameter and in which the height of the orifice is equal to 4 times its diameter. The spinning is performed at a constant flow rate per orifice of 1.68 g/min. The filaments are cooled by a transverse air stream to room temperature in the presence of moisture (RH = 60%), blown at a speed of 50 m/min. The filaments are assembled together and sized simultaneously and are then mingled by means of a pneumatic nozzle (2 bars air pressure) and wound at different speeds: 4200-5000-5800 m/min.

The control yarn is obtained in an identical manner but lower spinning speeds were produced for the evaluation of the gain in output efficiency from values of elongation and break.

The characteristics of the yarns are collated in the following table:

| | Speeds m/min | 1) 0.05 | 2) 0.25 | 3) 0.50 | Control |
|---|---|---|---|---|---|
| COUNT in dtex | 4200 | 26.9 | 29.1 | 28.2 | 28 |
| | 5000 | 24.7 | 24.3 | 24 | 23.5 |
| | 5800 | 18.3 | 21 | 20.3 | 20.1 |
| TENACITY cN/tex | 4200 | 26.5 | 26.4 | 28.4 | 36.7 |
| | 5000 | 27.4 | 29 | 29.3 | 35.7 |
| | 5800 | 30.8 | 30.1 | 30.4 | 37.6 |
| YOUNG'S MODULUS cN/tex | 4200 | 110 | 104 | 110 | 127 |
| | 5000 | 136 | 126 | 123 | 137 |
| | 5800 | 161 | 148 | 147 | 157 |
| BW SHRINKAGE % | 4200 | 3.1 | 2.8 | 3.3 | 2.8 |
| | 5000 | 4.2 | 3.7 | 3.9 | 4.3 |
| | 5800 | 5.1 | 4 | 4.7 | 4.3 |
| SONIC MODULUS | 4200 | 269.5 | | | 279.9 |
| | 5000 | 310.4 | | | 313.7 |
| | 5800 | 348 | | | 362.4 |
| BIREFRINGENCE | 4200 | 38.7 | | | 43.7 |
| | 5000 | 41.9 | | | 42.8 |
| | 5800 | 43.0 | | | 44.7 |
| % ELONGATION | 1000 | | | | 300 |
| | 1400 | | | | 225 |
| | 1800 | | | | 170 |
| | 2000 | | | | 160 |
| | 2400 | | | | 130 |
| | 2800 | | | | 110 |
| | 3200 | | | | 98 |
| | 3600 | | | | 85 |
| | 3800 | | | | 80 |
| | 4000 | | | | 78 |
| | 4200 | 87.6 | 88.3 | 94.5 | 74.8 |
| | 5000 | 74.2 | 75 | 81.5 | 68.7 |
| | 5800 | 70.2 | 71 | 72.6 | 61.7 |
| % GAIN IN OUTPUT EFFICIENCY | 4200 | 20.0 | 22.0 | 28.9 | |
| | 5000 | 16.5 | 21.1 | 34.0 | |
| | 5800 | 20.8 | 23.5 | 26.9 | |

According to the above values it is noted that the best gains in output efficiency are obtained with the highest silica loadings. Such yarns are intended for texturing on the usual false-twist machines.

EXAMPLES 4 AND 5

The process employed in Examples 1 to 3 is reproduced using a pyrogenic silica of the same specific surface and density, surface-treated with octamethylcyclotetrasiloxane in gaseous phase to avoid reagglomeration.

A master mix containing 5% of treated silica is prepared as indicated in Examples 1 to 3. The master mix is introduced in the form of granules at the same time as the polyamide to be processed into a twin-screw blending extruder heated to a temperature rising between 260° and 270° C. and with a rate of rotation of 300 revolutions/min. A vacuum zone ensures the drying of the polymer in the final part of the extruder.

The final silica content and the means interparticular distance in the final polymer are as follows:

| Ex. | Silica content by weight | Mean interparticular distance between aggregates | Aggregate size |
|---|---|---|---|
| 4 | 0.5% | 0.7 μm | 0.1 μm |
| 5 | 1% | 0.6 μm | 0.1 μm |

The silica-filled polyamide is spun though a die plate maintained at 282° C. comprising 2 times 10 orifices of round section 0.39 mm in diameter and in which the height of the orifice is equal to 4 times its diameter. The spinning is carried out at constant count. The filaments are cooled with a transverse air stream to room temperature in the presence of moisture (RH=60%), blown at a speed of 48 m/min. The filaments are converged and sized simultaneously and then mingled by means of a pneumatic nozzle (2.2 bars air pressure) and wound at different speeds: 4800–5500 m/min.

The control yarn is obtained in an identical manner (but lower spinning speeds were produced for the evaluation of the gain in output efficiency from elongation values).

For reasons of uniformity of the various test, the elongation values were measure at a stress of 45.6 cN/tex, identical for all the tests.

The elongation values of the yarns are collated in the following table:

| Speed m/min | % $SiO_2$ | % Elongation | % Gain in output efficiency |
|---|---|---|---|
| 4800 | 0 | 66.6 | — |
| 4800 | 0.5 | 73.9 | 17 |
| 4800 | 1 | 76.1 | 21.5 |
| 5500 | 0 | 56.7 | — |
| 5500 | 0.5 | 64.2 | 11 |
| 5500 | 1 | 67.4 | 15.9 |

We claim:

1. In a process for improving the output efficiency during the spinning of a polyamide-based preoriented yarn at a speed of at least 4000 m/min, the improvement comprising introducing, before the spinning, a quantity of 0.05 to 1% by weight of pyrogenic silica of particle size of between 5 and 15 nm into the molten polymer in the form of dispersion in a master mix of the same polyamide as that intended to be processed, the filaments after spinning being then cooled by means of a gas stream at room temperature and then sized and wound at a speed of between 4200 and 5800 m/min.

2. Process according to claim 1, wherein the gain in output efficiency is at least 10% based on the measurement of the elongation.

3. Process according to claim 1, wherein the gain in output efficiency is at least 15% based on the measurement of the elongation.

* * * * *